United States Patent [19]

Logan

[11] 4,155,034

[45] May 15, 1979

[54] SATURABLE REACTORS WITH FEEDBACK

[75] Inventor: Robert J. Logan, Sheffield, England

[73] Assignee: Inductive Controls Limited, Sheffield, England

[21] Appl. No.: 888,293

[22] Filed: Mar. 20, 1978

[30] Foreign Application Priority Data

Mar. 22, 1977 [GB] United Kingdom ..... 12134/77

[51] Int. Cl.[2] ..... G05F 1/32

[52] U.S. Cl. ..... 323/75 S; 323/89 B; 323/89 M; 330/8

[58] Field of Search ..... 323/75 S, 87, 89 R, 323/89 B, 89 P, 89 M, 89 T, 56; 330/8, 63

[56] References Cited

U.S. PATENT DOCUMENTS 2,509,738 5/1950 Lord ..... 323/89 B 3,387,723 6/1968 Spanbauer ..... 323/89 B

FOREIGN PATENT DOCUMENTS 981334 1/1976 Canada ..... 323/75 S

*Primary Examiner*—Gerald Goldberg

*Attorney, Agent, or Firm*—Kemon & Estabrook

[57] ABSTRACT

A control circuit comprises two series-connected pairs of saturable reactors, the two pairs being connected in parallel between a supply line and a load. Between one pair of reactors are connected two back-to-back diodes, the center tap of which is connected to the common point of the other pair of reactors. The difference between the voltages across the reactor main windings causes feedback which increases the magnetization of the cores and reduces further the impedance of the low impedance windings.

3 Claims, 8 Drawing Figures

SATURABLE REACTORS WITH FEEDBACK

This invention relates to saturable reactors for controlling alternating current electrical supplies to loads such as electric motors.

It is well-known to control the current fed to a load from an a.c. supply by connecting a saturable reactor in series with the load and adjusting the impedance of the reactor by variation of the magnitude of a direct current supply to one or more excitation windings on the reactor.

The impedance of the reactor can be set at any level between a maximum value, which is achieved for zero excitation current, and a minimum value which is obtained when the excitation current is large enough to cause saturation of the core of the reactor.

British Patent Specification No. 864,714 describes a number of saturable reactor arrangements comprising, for each phase of the supply, two cores of high permeability grain-orientated magnetic material. Each core has mounted thereon two identical winding sections which serve as the main current supply windings when connected in series with the load, which may, for example, be a squirrel cage induction motor.

The excitation windings are also formed as two identical winding sections on each of the two cores. These windings are connected in series and are connected across a d.c. supply via a switch.

In the arrangement described in British Patent Specification No. 864,714, the main windings are connected, in effect, in a bridge configuration with a supply connected to one corner of the bridge and an output to the motor being taken from the opposite corner. A diode is connected between the other corners of the bridge.

Figure 1:
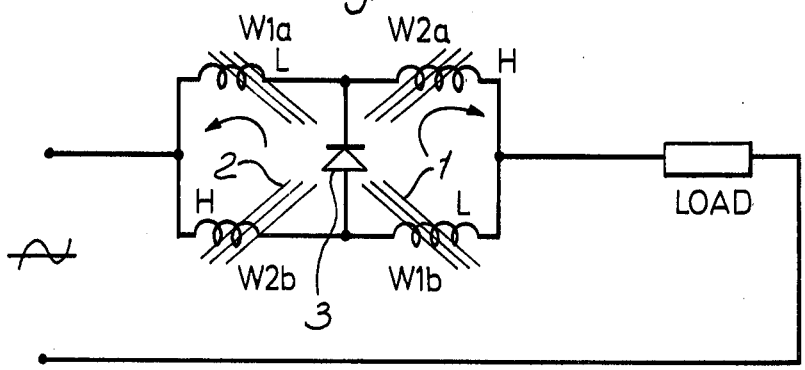

Such an arrangement is shown schematically in FIG. 1 of the accompanying drawings, wherein cores 1 and 2 provide magnetic coupling between the main winding section pairs W1*a*, W1*b* and W2*a*, W2*b* respectively.

The excitation winding sections are not shown in the schematic FIG. 1, but those winding sections are connected in such a configuration that the flux produced in the core 1 by the excitation winding sections will aid the flux produced by the main winding sections W1*a* and W1*b* in one half cycle, so that the core is driven into saturation and the impedance of the winding sections W1*a* and W1*b* is low, and will oppose the main winding flux in the other half cycle so that the winding impedance is high. The reverse situation exists in respect of main winding sections W2*a* and W2*b*.

Hence, in one half cycle the winding sections W1*a* and W1*b* will have a high impedance and will have a low voltage L thereacross, whilst the winding sections W2*a* and W2*b* will have a low impedance and will have a high voltage H thereacross. The production of the L and H voltages will be explained later. In the other half cycle, the impedance and voltage conditions are reversed. The major part of the load current flows, of course, through the low impedance winding sections.

The diode 3 connected between the junctions of the windings W1*a*, W2*a* and W1*b*, W2*b* has the effect of connecting the windings W1*a* and W1*b*, or the windings W2*a* and W2*b*, in series during alternating half cycles of the supply, the direction of load current flow through the windings being determined by the polarity of the diode. Due to the differences between the voltages across the windings sections W1*a* and W2*b* and W2*a* and W1*b*, notional circulating currents will be set up in the respective halves of the bridge, the currents flowing in the directions indicated by the arrows. These currents do not, of course, appear as separate currents, but as a change in the main current level. It is, however, convenient to consider them as circulating currents, distinct from the main currents.

The circulating currents cause the production of flux in the cores in the same direction as the excitation current flux, and so provide a useful self-excited positive feedback.

If the load is a squirrel cage motor it requires a very large starting current, and this current must not be limited by the impedances of the windings, otherwise the starting torque will be seriously reduced. Hence, every effort must be made to drive the cores hard into saturation on the relevant half-cycles, and the above-described feedback helps considerably in this respect.

Since the circulating current in each bridge section is caused by the difference between the H and L voltages across the low and high impedance coils, clearly the larger the difference between H and L the greater the circulating current, and hence the greater the flux and the lower the impedance of the excited windings.

However, the above-described circuit does not achieve the largest possible difference between the H and L voltages. This results from the fact that the coupling between the excitation winding sections and the main winding sections is not sufficiently tight to cause complete cancellation of the flux in the relevant core, so that the impedance of the high impedance winding sections is reduced. Part of the load current will therefore flow along a path through the windings W1*a* and W2*a* and along a path through the windings W1*b* and W2*b*. It will be realised that if the high impedance coils for the particular half cycle were of infinite impedance, no such current could flow.

This unwanted current flow causes some demagnetisation of the core on which the high impedance coils are mounted, and hence causes a decrease in the winding impedance and a resultant increase in the L voltage. This means that the feedback voltage (H−L) is less than it should be, and the total excitation is therefore reduced. Hence, the impedance of the low impedance windings is increased and the main load current is reduced. A loss of motor torque results.

It is an object of the present invention to provide a saturable reactor circuit in which the level of feedback is higher than in the above-described prior art circuit.

According to the invention, a saturable reactor circuit comprises a first magnetic core on which are mounted first and second main windings for carrying a.c. load current and at least one excitation winding for carrying d.c. excitation current; a second magnetic core on which are mounted third and fourth said main windings an at least one said excitation winding; two unidirectional current elements connected back-to-back between on end of said first main winding and one end of said third main winding; means interconnecting the junction between the unidirectional current elements and a junction between one end of said second main winding and one end of said fourth main winding; an input connected to the other ends of said first and fourth main windings; and an output connected to the other ends of said second and third main windings.

Figure 3:
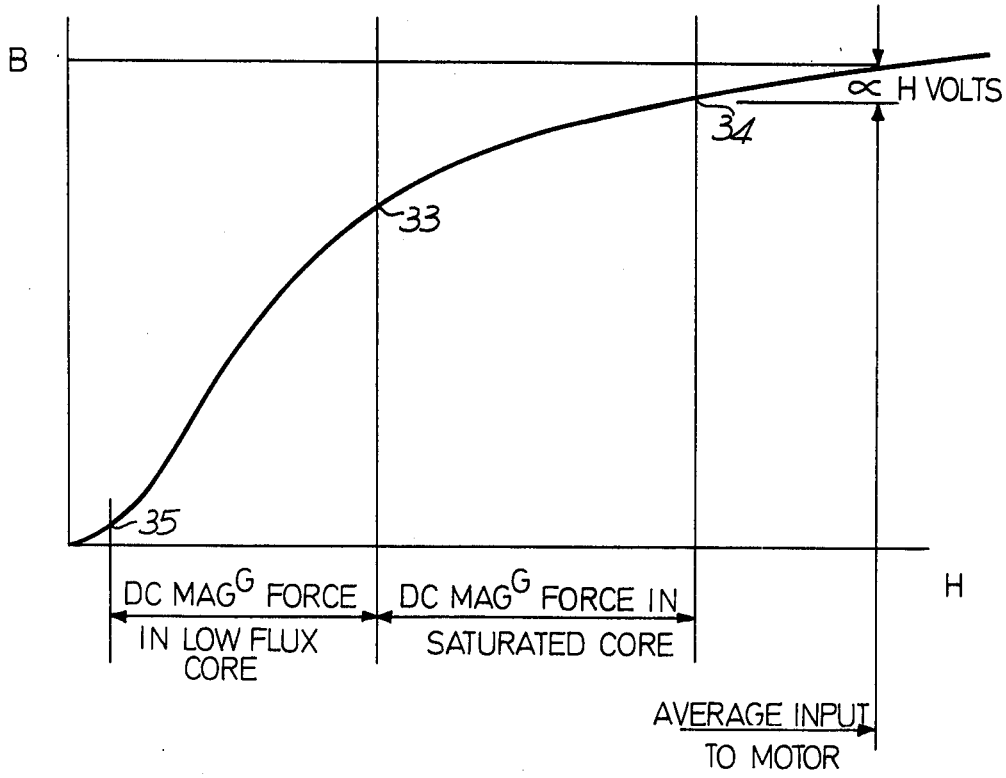
PRIOR ART Fig.3
Figure 2:
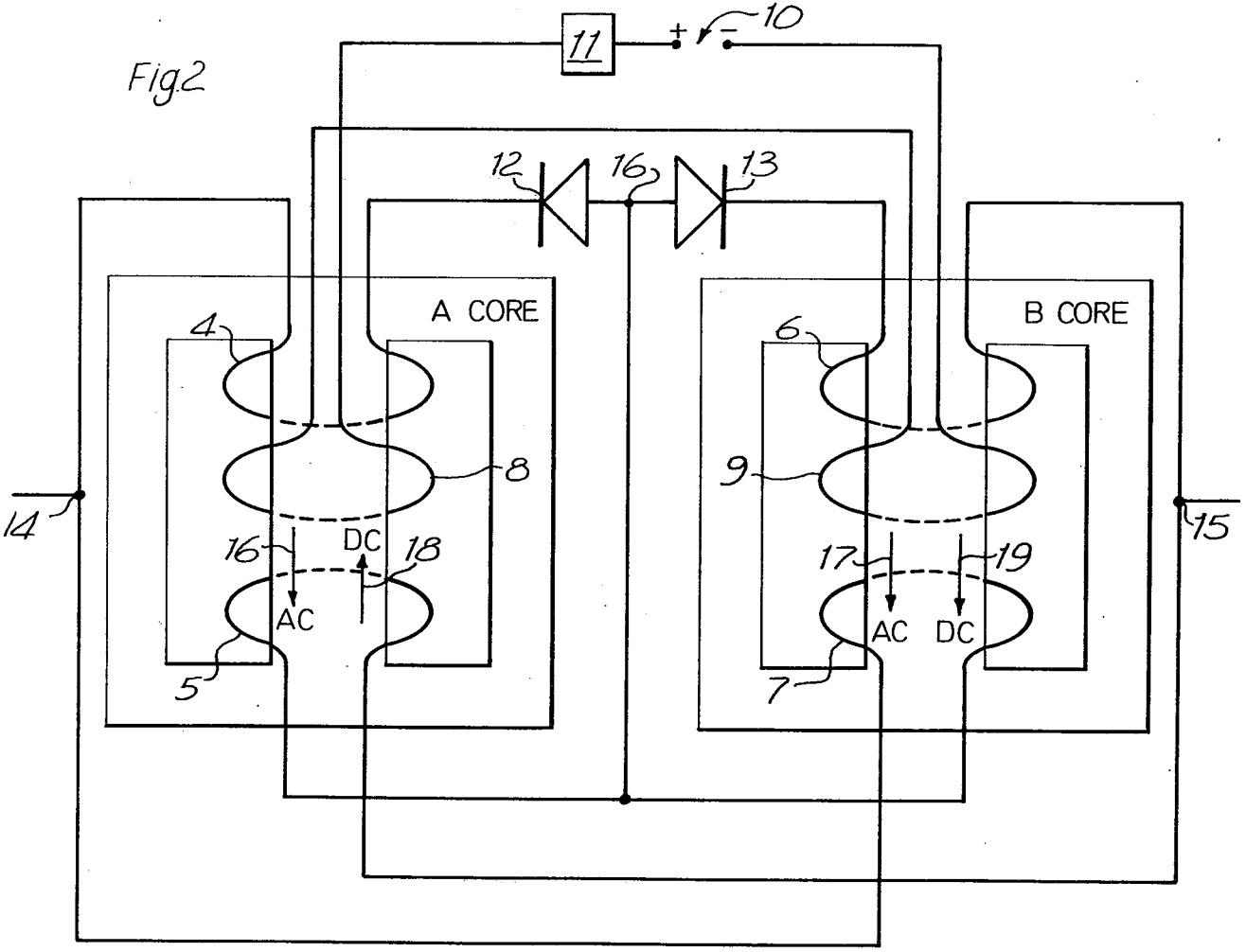
Figure 4A:
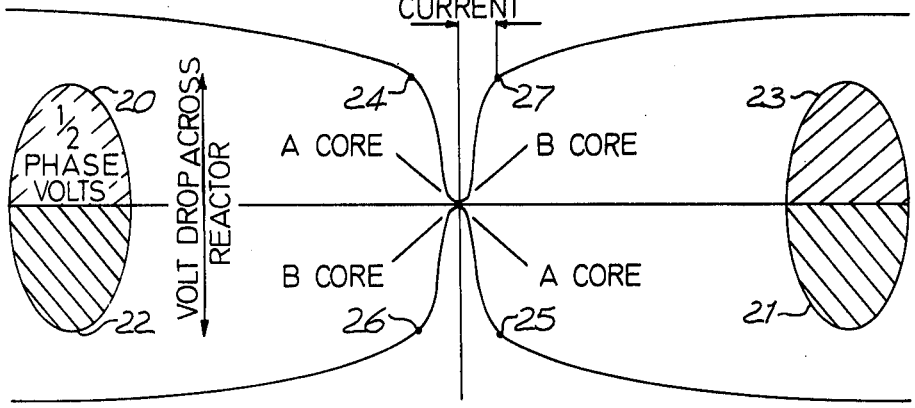
Figure 4B:
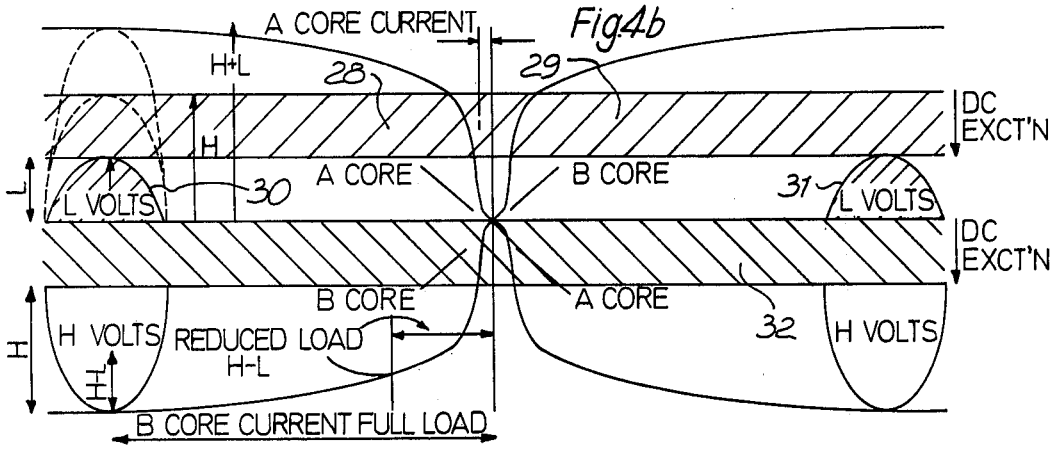
Figure 4C:
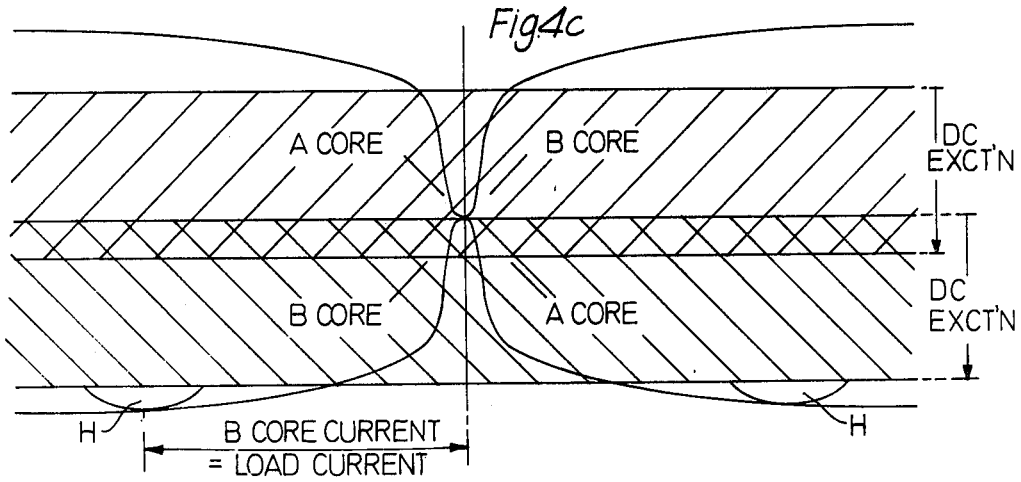
Figure 5:
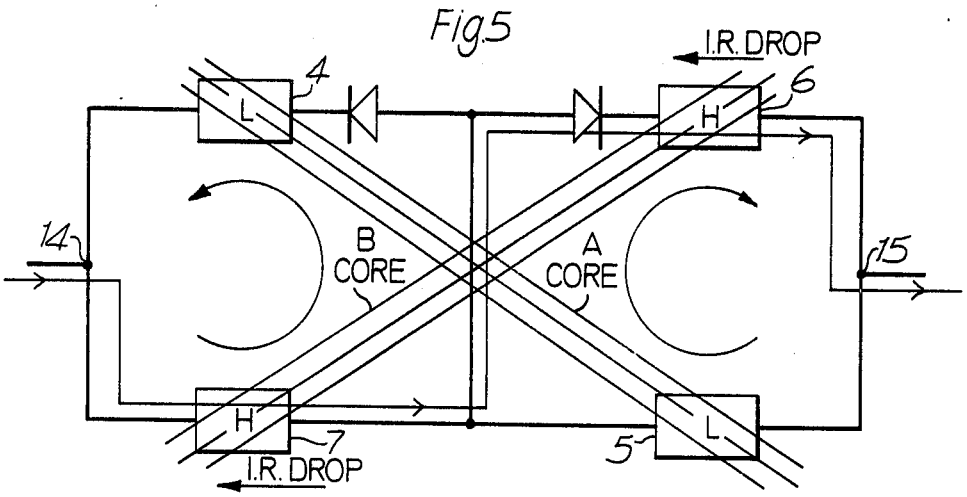
Figure 6:
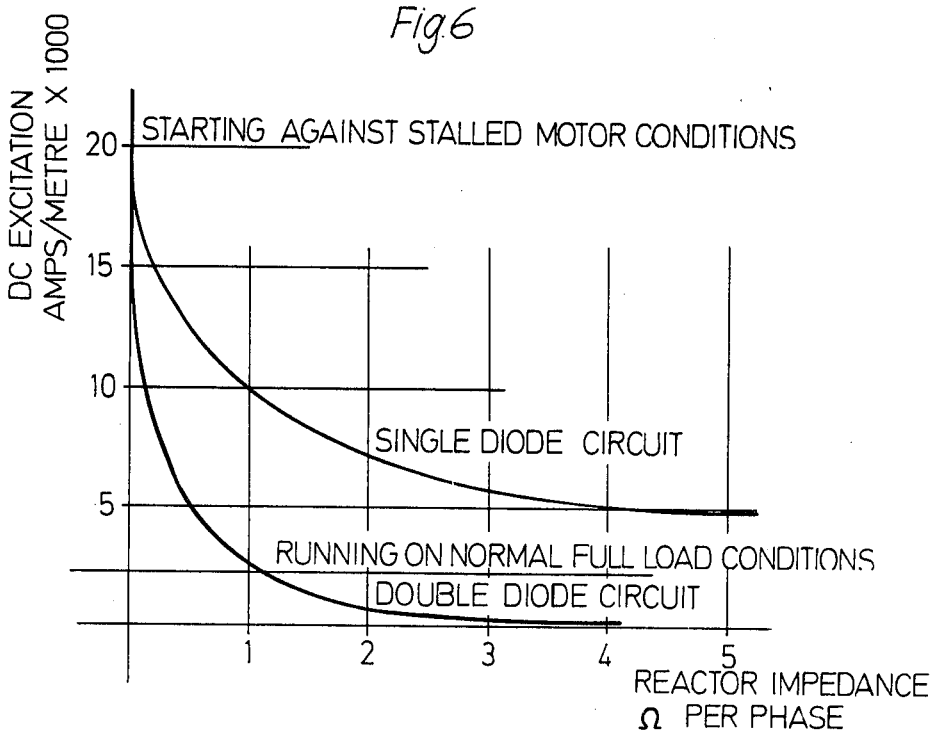

An embodiment of the invention will now be described, by way of example, with reference to the accompanying drawings, in which:

FIG. 1 is a schematic diagram of the prior art circuit as described above,

FIG. 2 is a schematic diagram of a saturable reactor circuit in accordance with the present invention, FIG. 3 is a magnetisation curve of a core suitable for use in the present invention, FIGS. 4(*a*) to 4(*c*) are curves illustrating the production of the feedback voltages in the saturable reactors, FIG. 5 shows schematically the circuit of FIG. 2 indicating the feedback current flow, and FIG. 6 shows two curves illustrating the reactor impedance/d.c. excitation characteristics of the prior art circuit and the circuit according to the present invention.

Referring to FIG. 2 of the drawings, a saturable reactor circuit in accordance with the present invention comprises two cores A and B on which are mounted pairs of main windings 4, 5 and 6, 7, respectively. Also mounted on the cores A and B are excitation windings 8 and 9, respectively, connected to a d.c. supply 10 via excitation current control means 11.

Diodes 12 and 13 are connected back-to-back, and their respective cathodes are connected to one end of the windings 4 and 6, respectively. The other end of the winding 4 is connected to an input point 14 and the other end of the winding 6 is connected to an output point 15.

One end of the winding 5 is connected to one end of the winding 7 and to the junction 16 between the diodes 12 and 13. The other end of the winding 5 is connected to the point 15, whilst the other end of the winding 7 is connected to the point 14.

In practice, three such circuits will normally be used, the points 14 of the circuits being connected to the respective lines of a three-phase supply, and the points 15 being connected to three input terminals of a three-phase load, such as an induction motor. Controlling the excitation current by adjustment of the control means 11 will vary the impedance of the main windings 4 to 7 and hence will vary the voltage applied to the load.

Arrows 16 and 17 indicate the directions of the alternating flux component produced in the cores A and B, respectively, due to the load current when the point 14 is positive with respect to the point 15. Arrows 18 and 19 indicate the directions of the flux components produced in the cores A and B, respectively, by the direct current flowing in the excitation windings 8 and 9.

It will be seen that the arrows 17 and 19 are in the same sense, so that the flux components are additive. Hence the magnetisation level of the core B will be high, approaching saturation of the core.

On the other hand, the arrows 16 and 18 are in opposite senses, so that the flux components tend to cancel each other and the core A is in a near to zero magnetisation condition.

If the load current flow path is now traced for this positive half-cycle, it will be seen that the current flows from the point 14, through the winding 7 which has a low impedance since the core B is near saturation, through the diode 13, through the winding 6 which also has a low impedance for the same reason, and to the point 15.

In the negative half-cycle, the directions of the arrows 16 and 17 are reversed so that the arrows 16 and 18 are now in the same direction whilst the arrow 17 and 19 are in opposite directions. The core A is now near saturation, whilst the core B is near to zero flux. The load current now flows from the point 15, through the low impedance winding 5, through the diode 12, through the low impedance winding 4, and to the point 14.

For the sake of clarity the windings 4–9 in FIG. 2 are shown merely as single-turn windings, but clearly these windings will have any desired number of turns.

The manner in which the H and L voltages are produced across the main windings will now be described with reference to FIGS. 4(*a*) to 4(*c*) of the drawings. Each of these figures represents diagrammatically the magnetisation curves for each core A and B for each half-cycle of the supply voltage.

FIG. 4(*a*) represents the condition wherein no excitation is applied to the windings 8 and 9. The reactor main windings are all in the high impedance state, so the phase voltage is dropped across the two reactors in series. Half of the phase voltage therefore appears across each reactor, indicated by the half-cycles 20 to 23. The magnetising current due to the applied voltage produces a flux density in the cores A and B rising to a maximum equal to the knee point values 24 tp 27.

FIG. 4(*b*) represents the condition wherein an excitation current of approximately half full excitation level is applied to the windings 8 and 9. When the excitation flux opposes the a.c. flux, as indicated in the top half of FIG. 4(*b*), the excitation flux, as represented by the shaded area 28 pushes the flux density down from the knee point to a level 29. The voltage L across the reactors when in this low flux condition is dependent upon the difference between the a.c. flux density and the d.c. flux density as indicated by half-cycles 30 and 31.

In the other half-cycle of each reactor, the d.c. excitation flux in the cores is as indicated by the shaded area 32. This results in a voltage H appearing across the reactors in this low impedance condition. The difference between the voltages H and L causes circulation of feedback currents round the main windings 4 and 7 and around the main windings 5 and 6 as shown in FIG. 5. These current cause the production of extra flux in the cores aiding the flux produced by the excitation current. Clearly the larger the value H−L, the larger the feedback current will be and the lower the main winding impedance will be for a given excitation current, or conversely the lower the excitation current can be for a given winding impedance.

FIG. 4(*c*) illustrates that the value of L becomes zero for full excitation, but that the value of H also reduces considerably. The value of H−L is therefore small and the advantage of the feedback is therefore lost if the excitation flux density is too high.

FIG. 3 shows a typical magnetisation curve for the reactor cores A and B. In the zero d.c. excitation condition, the magnetisation sets at the knee point 33, which for a suitable magnetic material, such as silicon iron, may be 17.8 kilogauss. The iron characteristic above this point is relatively flat, and a regulation of approximately 3% can be achieved by the equipment for all designed load conditions. The d.c. excitation either pushes the operating point up to a point 34 for the low impedance condition, or down to a point 35 for the high impedance condition.

As previously stated, in the prior art circuit of FIG. 1, current can flow in a demagnetising direction through the high impedance windings, and this reduces the value of H−L, thereby reducing the effective excitation and increasing the low impedance value of the main windings. The load current is thereby reduced.

The diodes 12 and 13 of the present invention inhibit the flow of load current along one of the two paths, namely that through the windings 4 and 6. The demagnetising effect is therefore reduced and a lower conductive main winding impedance results. Although only one of the two demagnetising current paths is inhibited and this current is therefore only halved, the improvement is greater than might be expected because the lower end of the magnetisation curve (as seen in FIG. 3) is non-linear. Hence, the remaining stray alternating flux in the lower flux core is less than half that which would exist in the absence of the diodes. The value of L is therefore considerably reduced, and the value of the feedback voltage H−L is considerably increased.

FIG. 4(*b*) shows that for a given d.c. excitation the H voltage varies with the load current. Hence the feedback varies with the load current and so the circuit tends to be self compensating. For a constant d.c. excitation the voltage drop across the reactor is approximately constant for any designed load variation.

The load current flowing in each low impedance winding causes a voltage drop across the resistance of the winding. This voltage drop acts in opposition to the feedback voltage H−L. Since the present invention results in an increase in H−L, one can afford to allow an increase in the resistance drop in the windings and still obtain a satisfactory feedback level. Hence, conductors of smaller cross section can be used for the main reactor windings. This results in a smaller window space being required in the core, and a shorter mean length of the magnetic circuit. This results in a substantial saving in iron and copper. Because the current density in the main windings will be higher, the reactors will run at a higher temperature and it may be necessary to provide an electrically-driven fan to cool the reactors. However, a considerable saving in cost will still result.

The resistance of the main windings will be more significant in low-power reactors than in high-power reactors. Hence, the feedback voltage will be disproportionately lower in a low-power equipment and the d.c. excitation will therefore have to be disproportionately large.

Modifications may be made to the circuit without departing from the scope of the invention. For example, more than one excitation winding section may be provided on each core.

FIG. 6 of the drawings illustrates the marked decrease in reactor impedance obtainable for a given excitation current in the double diode circuit of the present invention, as compared with the prior art single diode circuit. Conversely, of course, a given low reactor impedance can be achieved at a very much lower level of excitation in the present circuit than in the prior art circuit.

I claim:

1. A saturable reactor circuit, comprising a first magnetic core on which are mounted first and second main windings for carrying a.c. load current and at least one excitation winding for carrying d.c. excitation current; a second magnetic core on which are mounted third and fourth said main windings and at least one said excitation winding; two unidirectional current elements connected back-to-back between one end of said first main winding and one end of said third main winding; means interconnecting the junction between the unidirectional current elements and a junction between one end of said second main winding and one end of said fourth main winding; an input connected to the other ends of said first and fourth main windings; and an output connected to the other ends of said second and third main windings.

2. A circuit as claimed in claim 1, wherein the unidirectional current elements are diodes.

3. A circuit as claimed in claim 1, wherein the magnetic cores are formed of a silicon iron having a knee point at approximately 17.8 kilogauss.

* * * * *